US006655238B1

(12) United States Patent
Hsien

(10) Patent No.: US 6,655,238 B1
(45) Date of Patent: Dec. 2, 2003

(54) REINFORCEMENT TEETH STRUCTURE FOR RATCHET

(76) Inventor: Chih-Ching Hsien, No. 367, Pei Yang Rd., Feng Yuan, Taichung (TW)

( * ) Notice: Subject to any disclaimer, the term of this patent is extended or adjusted under 35 U.S.C. 154(b) by 3 days.

(21) Appl. No.: 10/289,249

(22) Filed: Nov. 7, 2002

(51) Int. Cl.[7] ..... B25B 13/46
(52) U.S. Cl. ..... 81/60; 81/58
(58) Field of Search ..... 81/60, 61, 62, 81/63, 63.1, 63.2, 58

(56) References Cited

U.S. PATENT DOCUMENTS 810,599 A * 1/1906 Ansorge ..... 81/60
3,838,614 A * 10/1974 O'Donnell ..... 81/60
5,979,274 A * 11/1999 Hsieh ..... 81/60
6,334,373 B1 * 1/2002 Hsieh ..... 81/60

* cited by examiner

*Primary Examiner*—Joseph J. Hail, III
*Assistant Examiner*—Hadi Shakeri
(74) *Attorney, Agent, or Firm*—Rosenberg, Klein & Lee

(57) ABSTRACT

A ratchet tool includes a head with an engaging ring rotatably received therein and a pawl is movably received in the head. The engaging ring has first teeth defined in an outer periphery thereof and the pawl has second teeth defined in a side thereof, the first teeth are engaged with the second teeth. An adjust angle "a" defined between a center of the engaging ring and two points of two adjacent first teeth of the engaging ring is 2 to 4 degrees. An angle "b" between two adjacent face of two adjacent second teeth 51 is larger than an angle "c" between two faces of any first tooth. A height "D" of any of the first teeth is not less than a height "d" of any of the second teeth. By the arrangement, the number of the engagement of the first and second teeth is enough to output a largest torque without slipping over or being damaged.

1 Claim, 5 Drawing Sheets

REINFORCEMENT TEETH STRUCTURE FOR RATCHET

FIELD OF THE INVENTION

The present invention relates to a ratchet tool that has a toothed engaging ring rotatably received in the head of the tool and an adjacent angle 2–4 degrees is defined from a center of the engaging ring to any two adjacent teeth on the engaging ring.

BACKGROUND OF THE INVENTION

A conventional ratchet tool is shown in FIGS. 1 and 2 and generally includes a head 10 with a hole 11 for receiving an engaging ring 20 therein and fastening clamps 13 are used to retain the engaging ring 20 in the hole 11. A side hole 12 is defined in a side of the head 10 and communicates with the hole 11. A pawl 21 is movably received in the side hole 12 and biased by a spring 22. An end cap 23 seals the side hole 12 such that the pawl 21 and the spring 22 are retained in the side hole 12. The pawl 21 has teeth 211 which are matched with the teeth 201 on an outer periphery of the engaging ring 20. An inherent problem is that, as shown in FIG. 3, the torque output is small if the number of the matched teeth 211 and 201 is less than a certain amount of number. Gaps between the teeth 211, 201 will be too large. As shown in FIG. 4, a larger number of the matched teeth 211 and 201 requires much precise machining processes and the teeth 211, 201 could slide over each other because of the short height of the teeth 211, 201.

The present invention intends to provide reinforcement teeth structure for the engaging ring and the pawl so as to increase the torque that the ratchet tool can output.

SUMMARY OF THE INVENTION

In accordance with one aspect of the present invention, there is provided a ratchet tool that includes a head with a hole in which an engaging ring is received, and a side hole is defined from a side of the head so as to receive a pawl biased by a spring therein.

The engaging ring has first teeth defined in an outer periphery thereof and which are engaged with second teeth defined in a side of the pawl. An adjust angle "a" of 2 to 4 degrees is defined between a center of the engaging ring and two points of two adjacent first teeth of the engaging ring. An angle "b" between two adjacent face of two adjacent second teeth is larger than an angle "c" between two faces of any first tooth. A height "D" of any of the first teeth is not less than a height "d" of any of the second teeth.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
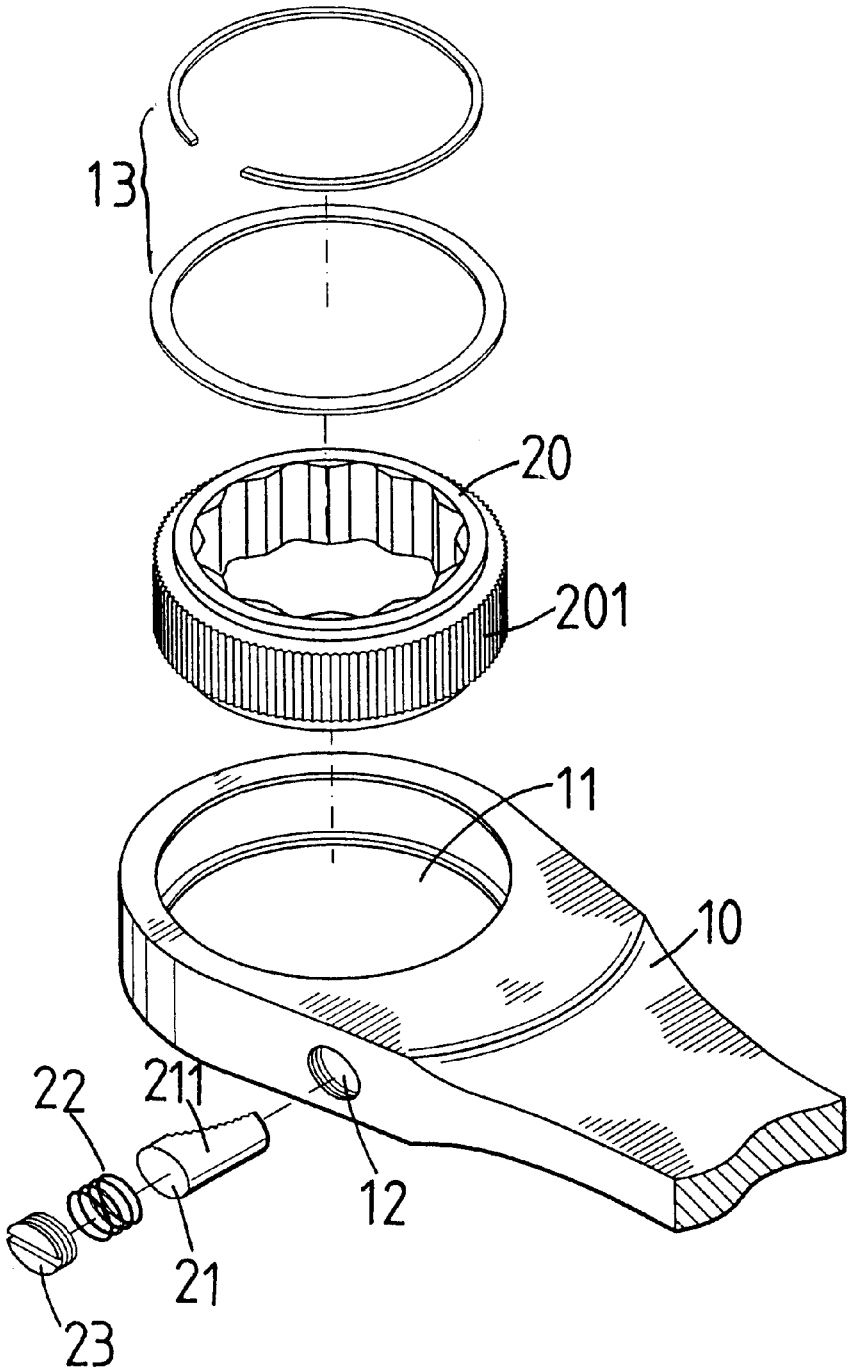
FIG. 1 PRIOR ART
FIG. 1 is an exploded view to show a conventional ratchet tool.
Figure 2:
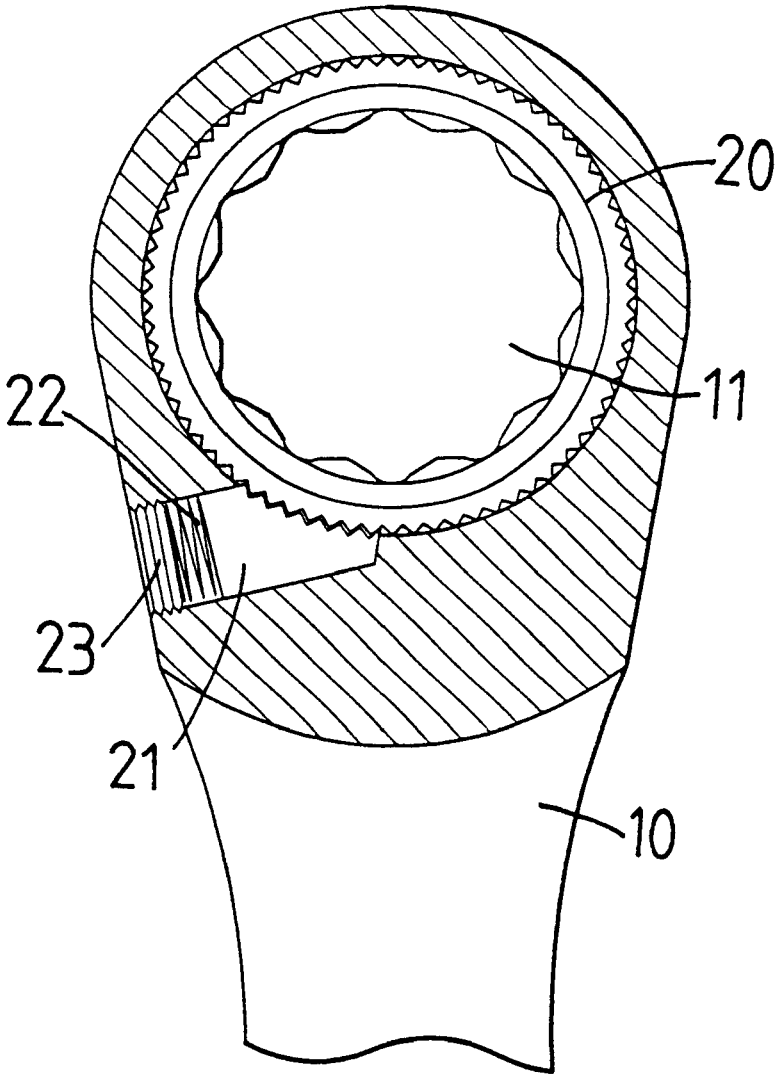
FIG. 2 PRIOR ART
FIG. 2 is a cross sectional view to show the conventional ratchet tool.
Figure 3:
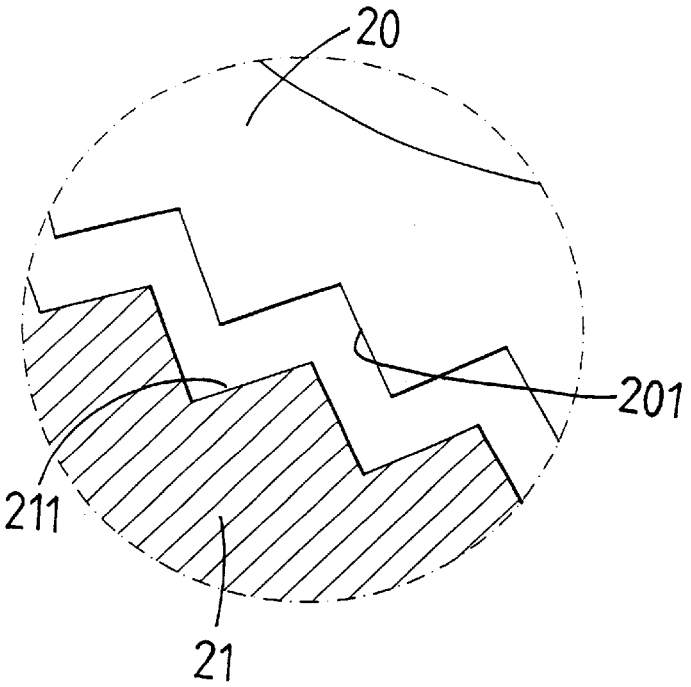
FIG. 3 PRIOR ART
FIG. 3 shows the engagement of less number of teeth of the engaging ring and the pawl of a conventional ratchet tool.
Figure 4:
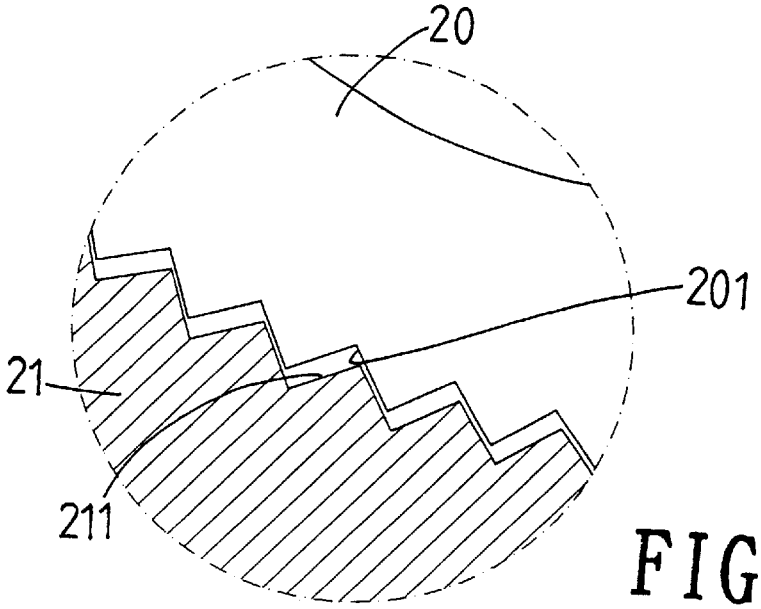
FIG. 4 PRIOR ART
FIG. 4 shows the engagement of to many teeth of the engaging ring and the pawl of a conventional ratchet tool.
Figure 5:
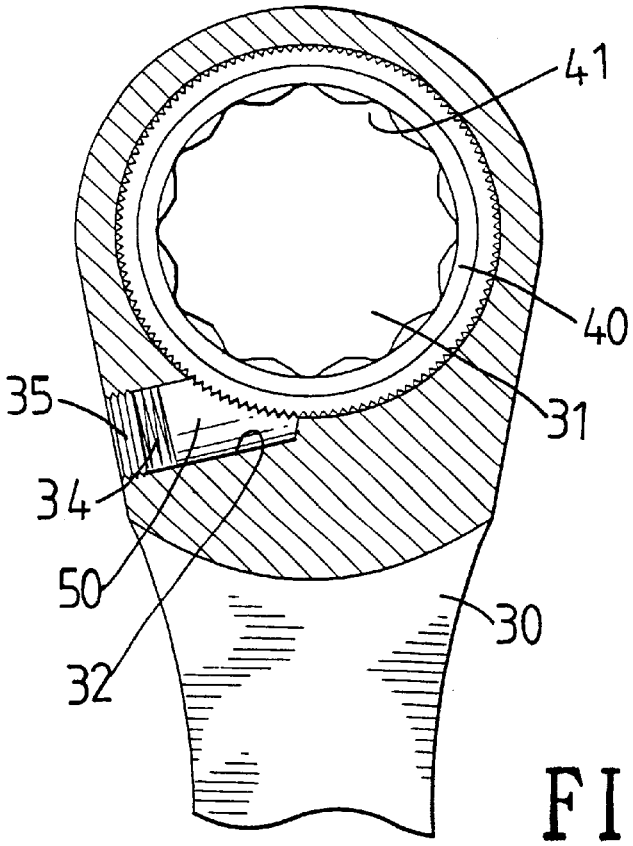
FIG. 5 is a cross sectional view to show the ratchet tool of the present invention.
Figure 6:
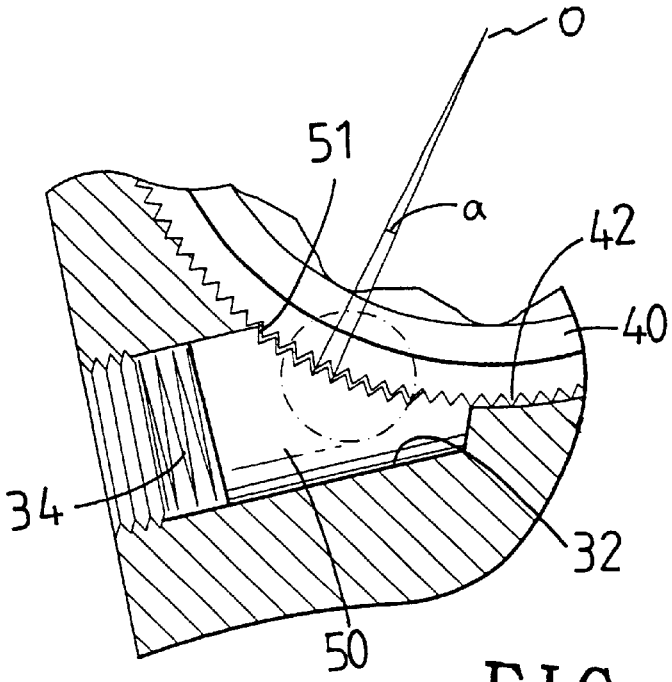
FIG. 6 shows the engagement of the teeth of the engaging ring and the pawl of the ratchet tool of the present invention.
Figure 7:
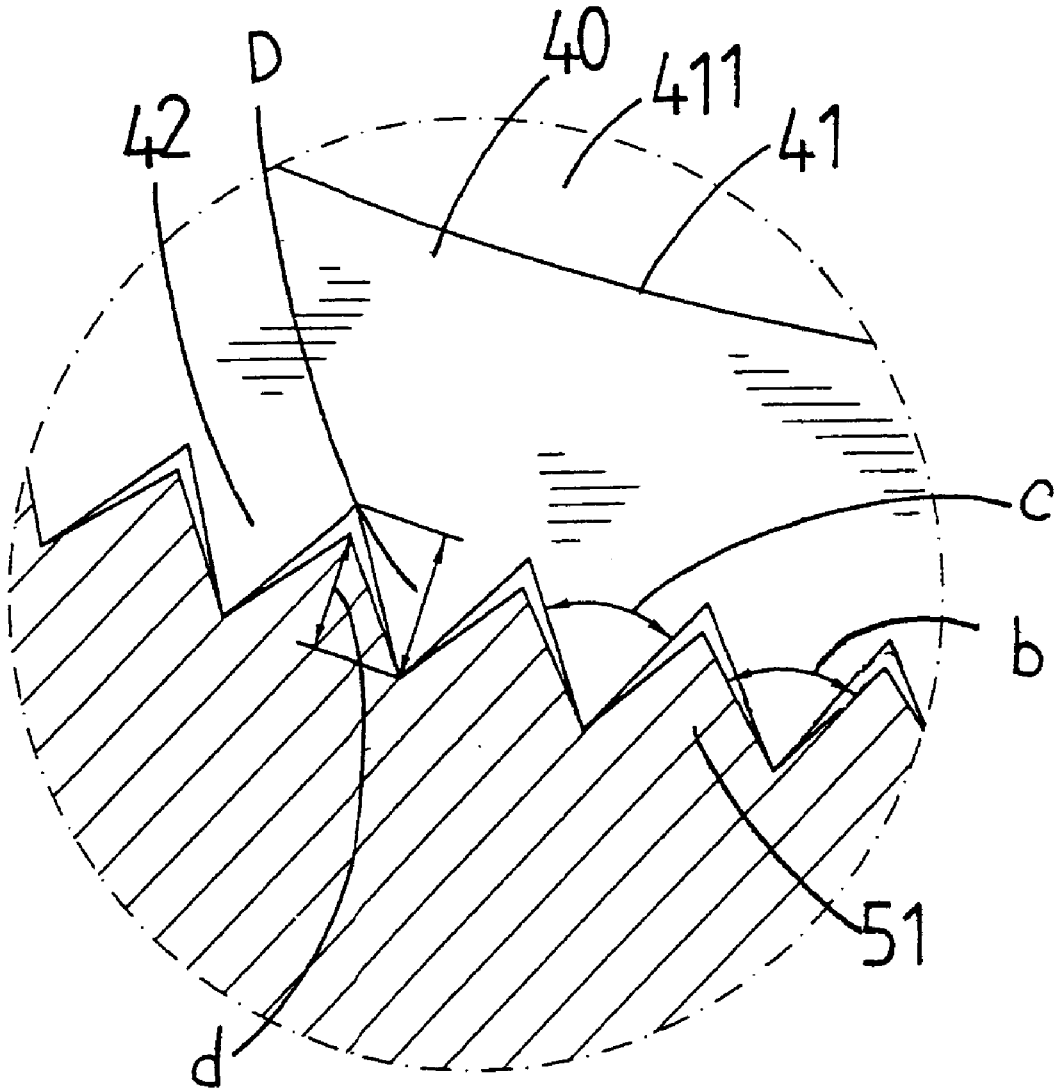
FIG. 7 shows the detail restrictions of the teeth of the engaging ring and the pawl of the ratchet tool of the present invention.

Referring to FIGS. 5 to 7, the ratchet tool of the present invention comprises a head 30 having a hole 31 defined therethrough and an engaging ring 40 is rotatably received in the hole 31 and has first teeth 42 defined in an outer periphery thereof. Each of said teeth is defined by two faces intersection at an apex. The engaging ring 40 has a polygonal inside 41 so as to clamp an object to be tightened or loosened.

A side hole 32 is defined from a side of the head 30 and communicates with the hole 31. A pawl 50 is biased by a spring 34 and movably received the side hole 32. An end cap 35 threadedly seals the side hole 32 so as to restrict the spring 34 and the pawl 50 from dropping from the side hole 32. A plurality of second teeth 51 are defined in a side of the pawl 50 and engaged with the first teeth 42 of the engaging ring 40. The spring 34 exerts a force to urge the pawl 50 toward the engaging ring 40 so as to keep the engagement status of the first teeth 42 and the second teeth 51.

An adjust angle "a" of 2 to 4 degrees is defined between a center "O" of the engaging ring 40 and apices of two adjacent first teeth 42 of the engaging ring 40. An angle "b" between two adjacent face of two adjacent second teeth 51 is larger than an angle "c" between the two faces of any first teeth 42. A height "D" of any of the first teeth 42 is not less than a height "d" of any of the second teeth 51.

The angle "a" makes the contact area between the first teeth 42 and the second teeth 51 to be maximum and the restrictions mentioned above allows the number of the teeth 42, 51 for the engaging ring 40 and the pawl 50 to be optimized.

While we have shown and described the embodiment in accordance with the present invention, it should be clear to those skilled in the art that further embodiments may be made without departing from the scope of the present invention.

What is claimed is:

1. A ratchet tool comprising:

a head with a hole defined therethrough and a side hole defined from a side of the head and communicating with the hole;

an engaging ring rotatably received in the hole and having first teeth defined in an outer periphery thereof, each of said teeth being defined by two faces intersection at an apex, a pawl biased by a spring and movably received the side hole, second teeth defined in a side of the pawl and engaged with the first teeth of the engaging ring, an adjust angle "a" which is 2 to 4 degrees being defined between a center of the engaging ring and apices of two adjacent first teeth of the engaging ring, an angle "b" between two adjacent faces of two adjacent second teeth being larger than an angle "c" between said two faces of any first teeth, a height "D" of any of the first teeth being not less than a height "d" of any of the second teeth.

* * * * *